United States Patent [19]

Zucker

[11] 3,995,838

[45] Dec. 7, 1976

[54] ARRANGEMENT FOR THE PRODUCTION OF A SUSPENSION OF HIGHLY SWELLABLE SUBSTANCES

[75] Inventor: Friedrich J. Zucker, Norf, Germany

[73] Assignee: Supraton Auer & Zucker OHG, Allwrheiligen, Germany

[22] Filed: Jan. 20, 1975

[21] Appl. No.: 542,274

[30] Foreign Application Priority Data

Jan. 23, 1974 Germany ..... 2403053

[52] U.S. Cl. ..... 259/10; 259/DIG. 30

[51] Int. Cl.[2] ..... B01F 3/10; B01F 5/08

[58] Field of Search ..... 259/5, 6, 7, 8, 9, 10, 259/21, 22, 23, 24, 25, 26, 18, DIG. 30

[56] References Cited

UNITED STATES PATENTS

| | | | |
|---|---|---|---|
| 2,498,209 | 2/1950 | Iredale | 259/DIG. 30 |
| 3,212,757 | 10/1965 | Martin | 259/18 |
| 3,671,020 | 6/1972 | Krup | 259/10 |
| 3,682,447 | 8/1972 | Zucker | 259/6 |
| 3,856,269 | 12/1974 | Fothergill | 259/18 |

*Primary Examiner*—Robert W. Jenkins
*Attorney, Agent, or Firm*—Diller, Brown, Ramik & Wight

[57] ABSTRACT

This disclosure relates to apparatus for the production of a highly swellable or expandable solid-liquid substance from solid and liquid components by continuously metering and combining the latter components and prior to the expansion of the solid component subjecting the admixed components to high shearing forces within a mixing chamber by means of a rotatable rotor and a stationary stator having oppositely directed generally opposing rings which are radially offset to each other.

4 Claims, 1 Drawing Figure

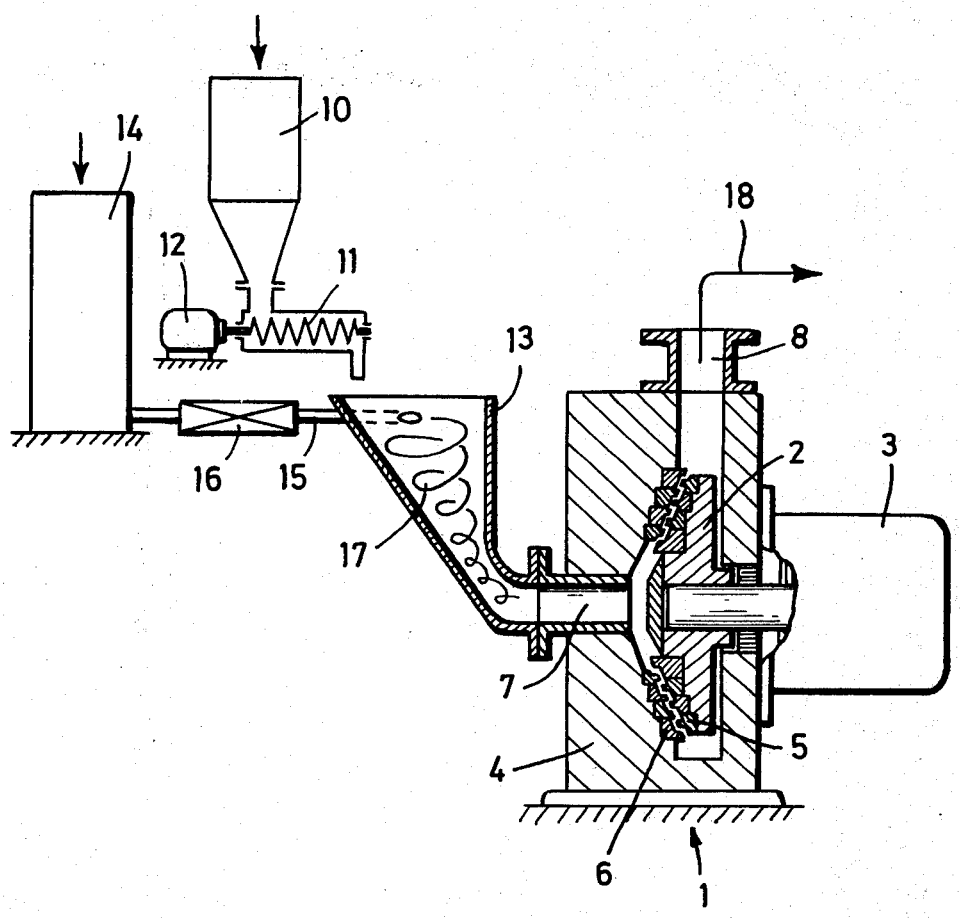
10
14
12
11
18
13
8
2
3
16
15
17
7
5
4
6
1

ARRANGEMENT FOR THE PRODUCTION OF A SUSPENSION OF HIGHLY SWELLABLE SUBSTANCES

The present invention relates to a method of and an apparatus for the production of a suspension of highly swellable or expandable substances with the ratio by weight between the amounts of solid components and liquid components being kept constant.

It is well known to use highly expandable or swellable products or substances in a number of industries as, for example, the use of caraginates employed as thickners in food industries as, for example, in the production of ice cream or in the cosmetic industry in the production of toothpaste and the like. Another example of the use of highly swellable substances or suspensions is the introduction of bentonite (activated clay mineral) suspensions or substances in the building industry for ceiling shutter walls or like barricades or forms which are typically employed in trenching operations to prevent the earth from accidentally refilling the trench. Such highly swellable substances are also used for lining and supporting holes drilled in the earth as, for example, well holes.

It is further known that the efficiency of such swelling agents, i.e., the increase in the apparent viscosity which can be achieved relative to the solid-to-liquid ratio, is highly dependent on the degree to which the solid component is dispersed in or admixed with the liquid component of the total substance or suspension. In the conventional intermittent method which by way of example may be simply considered to be the use of a stirrer mechanism in a container it is possible to achieve a satisfactory dispersion of the liquid and solid components if the stirring action is carried out for a sufficiently long period of time. Thus, a suspension of bentonite can be produced by stirring an admixture in a container with a capacity of about 3,000 litres by stirring for at least 6 hours. Needless to say, such an operation is very time consuming and cannot be generally employed, particularly on a commerical basis and not at all upon a continuous mode of manufacture.

The continuous dispersing of solid components in or with liquid components is also in common use provided the ratio between the solid components and liquid components amount to about 10 to 70% of the solid components and 90 to 30% of the liquid components. However, any attempts at dispersing these components in a continuous manner has been found to be very difficult in connection with highly swellable or expandable solid components in which the latter is of a percentage below 10% by weight. This is due to the fact that the addition of the solid component to the liquid component causes a rise in viscosity which is sufficient, even with incomplete dispersion, to prevent any further dispersion by the action of conventional stirring forces. Additionally, the increase in the velocity is also sufficient to render it impossible to treat the solid-liquid admixture or substance in a desired manner primarily because the flow behavior precludes the continuous supply of the components in a continuous fashion. There therefore arises the conflicting situation of it not being apparently possible to carry out any increase in the velocity of a suspension which could, however, in principle be achieved if the suspension were exposed to shearing forces because the increase in the apparent viscosity is so great that any supply of the components to the shearing apparatus is rendered impossible due to clogging resulting from the excessive swelling of the expandable solid component. In basically any form of a continuous operation in which the solid and liquid components are fed to a dispersing or shearing device there necessarily is contact between the latter components. If the quantity of the solid component is so small that the relative speed of supply of the solid component is lower than the speed of penetration of the liquid into the solid clogging of the supply conduits for the solid component is produced, and in certain circumstances an undesirable retardation and wetting of the solid component occurs by the wicking, penetration, or entry of the liquid component into the solid particles.

In view of the foregoing it is a primary object of the present invention to produce substances or suspensions of liquid components and highly swellable or expandable solid components in a solid component-liquid component ratio of less than 10:90% by weight without there being any danger of the inlet conduits, channels or the like to the shearing or mixing device becoming clogged during continuous operation, and as a result the relatively low fraction of the solid component is better dispersed and thus better utilized than heretofore provided for in the prior art.

The present invention is particularly characterized by the fact that the solid components and the liquid components are continuously measured or metered in predetermined quantities and are admixed or combined before being subject to a mixing apparatus which produces high shearing forces and in effect the admixed liquid and solid components are almost immediately introduced after admixture into the mixing apparatus.

The invention is further defined by a specific mixing apparatus having a mixing chamber defined between a rotatable rotor and a stationary stator each of which has a plurality of opposing rings disposed in radially offset relationship to therebetween defined a generally transversely sinesoidal flow path through which the admixed components are impelled both radially outwardly and simultaneously swirlled until eventually discharged through an appropriate outlet.

By virtue of the apparatus just described it is possible with certainty to produce a complete highly swellable solid-liquid substance from solid and liquid components even though the solid component content is substantially less than 10% by weight of the total solid-liquid substance. Thus, before the solid components begin to swell they are disposed in the mixing chamber and are subjected to high shearing centrifugal forces due to the rotation of the rotor. As the high shearing forces are continually applied the overall substance remains in a sufficiently liquid state due to the generally thixotropic behavior of the substance and in an extremely short period of time (within one to two minutes) the substance may be continuously removed from the mixing chamber and immediately used thereafter. Practically no noticable preparatory time is required, the cost of construction of the apparatus is additionally comparatively low, and the certainty of a suspension or substance being produced with the required properties is satisfactorily provided.

With the above and other objects in view that will hereinafter appear, the nature of the invention will be more clearly understood by reference to the following detailed description, the appended claimed subject matter, and the several views illustrated in the accompanying drawings.

IN THE DRAWING

The single illustration of the drawing is a diagrammatic side elevational view, partly in cross-section, and illustrates the manner in which liquid and highly expandable solid components are metered, admixed, and fed to a mixing chamber in which they are subjected to high shearing forces as a result of a rotating rotor and a cooperative stator, both of which have radially offset circular rings or teeth.

A novel apparatus constructed in accordance with this invention for the production of a highly swellable or expandable solid-liquid substance or suspension from solid and liquid components is generally designated by the reference numeral 1 and includes a rotor 2 carried by a shaft (unnumbered) of a geared motor 3. The rotor 2 is disposed in a chamber (unnumbered) of a housing 4 and a plurality of circular rings 5 of the rotor 2 are in opposed relationship to a plurality of rings 6 which are likewise of a circular configuration and define a stator. The area of mixture or the mixing chamber may be considered to be the area between the rings 5, 6 which, as viewed in transverse cross-section, defines a generally sinesoidal flow path due to the radially offset relationship of the rings 5, 6. Thus, upon the introduction of the solid-liquid admixture through an inlet 7 into the housing 4 between the rings 5, 6, the rotation of the rotor 2 subjects the admixture to high shearing forces created by the inherent radially outwardly impelling forces and the swirlling forces created by the rotation of the rotor 2 with the radial forces being additionally employed to impel the completely dispersed substance through an outlet 8 of the housing 4 disposed in radial relationship to the mixing chamber and the axis (unnumbered) of the rotor 2 with, of course, appropriate conduits 18 being provided to direct the expanded solid-liquid substance to its eventual point of use.

Though the details of the rotor and stator are not specifically set forth herein except those described heretofore, reference may be made to co-pending application Ser. No. 533,886 in the name of Friedrich J. Zucker, filed Dec. 18, 1974 entitled PROCESS FOR CONTINUOUS CATALYTIC HYDROGENATION.

In order to continuously produce the swollen solid-liquid substance eminating from the outlet 8 the solid expandable or swellable material is supplied from a storage tank or hopper 10 by means of a measuring or metering screw 11 driven by a motor 12 to an upper end portion (unnumbered) of a funnel-shaped hopper 13. The measuring worm or screw 11 may be driven or rotated intermittently or continuously, but whether driven intermittently or continuously a continuous metering action is achieved and the speed of rotation of the metering worm 11, be it on a stop and go or a continually revolving basis is dependent upon like metering of a liquid delivered to the funnel-shaped hopper 13 from a container 14 through an adjustable flow meter 16 and a conduit 15. The liquid component is continuously replenished in the container 14, as is the solid component, as indicated by the unnumbered headed arrows associated with the container 14 and the hopper 10. Likewise, in lieu of the measuring screw or worm 11 it is possible to employ a measuring conveyor-type weighing device or the like.

The supply pipe 15 opens into the funnel-shaped hopper 13 tangentially so that a spirally and downwardly narrowing liquid flow 17 is provided in such manner that the solid components or particles brought into contact with the liquid are admixed and then immediately delivered through the inlet 7 into the mixing chamber between the rings 5, 6. Though the inlet 7 is shown as a separate tube or pipe coupled to an open narrow end (unnumbered) of the hopper 13, it is pointed out that these latter components could be of an integral one-piece construction or alternatively the pipe 7 could be eliminated and the outlet at the narrow end of the hopper 13 could be coupled directly to the housing 4 adjacent the opening (unnumbered) formed therein receiving the pipe 7.

By means of the apparatus 1 the ratio between the solid components and the liquid components is kept constant throughout the operation and due to the rapid transfer of the components through the hopper 13 the admixed liquid and solid components are delivered into the mixing chamber of the housing 4 before the swellable or expandable solid component begins to expand or swell. The invention has particular advantage in forming substances of activated clay material (bentonite) and these are produced in a solid-liquid ratio of less than 10%:90% by weight. With bentonite there is produced a substance or suspension with a sufficient apparent viscosity in order, for example, to prevent the collapse of shutter walls of a depth of 6 meters and a slot width of 300mm when in use in an average consistency soil (sandy and/or loamy). The apparatus as thus described makes it possible to produce suspensions of liquids and other highly swellable solid substances with a proportion by weight of the solid components being substantially lower than 10%.

While preferred forms and arrangements of parts have been shown in illustrating the invention, it is to be clearly understood that various changes in detail and arrangement of parts may be made without departing from the spirit and scope of this disclosure.

I claim:

1. Apparatus for the production of a highly swellable solid-liquid substance from solid and liquid components comprising means for continuously metering a solid expandable component, means for continuously metering a liquid component, means for continuously combining the metered solid and liquid components, said combining means includes a funnel-shaped container having a wide upper tapered inlet end and a narrower tapered lower outlet end, means for introducing the metered solid component into said funnel-shaped container at said upper end, means for tangentially introducing the metered liquid component into said funnel-shaped container at said upper tapered end thereby premixing the combined solid and liquid components by forming a spirally and downwardly narrowing flow thereof, a housing, a mixing chamber in said housing, means for imparting high shearing forces to said premixed components within said mixing chamber to form the highly swellable solid-liquid substance, an outlet for removing the substance from said mixing chamber, an inlet for introducing said premixed components into said mixing chamber, an outlet at said funnel-shaped container lower end, and said last-mentioned outlet being disposed immediately adjacent said mixing chamber inlet.

2. The apparatus as defined in claim 1 wherein said funnel-shaped container includes a sloping wall portion extending between said upper inlet and lower outlet ends, and said solid component introducing means introduces the solid component directly on said sloping wall portion at said upper inlet end whereby said tangentially introduced liquid component reacts in shear with said solid component during the spirally and downwardly narrowing flow thereof.

3. The apparatus as defined in claim 2 including a source of supply for said liquid component, said liquid component introducing means including a conduit leading from said source of liquid component supply, and a liquid metering valve in said conduit.

4. The apparatus as defined in claim 3 wherein said solid component introducing means introduces said solid component in a vertically downward direction.

* * * * *